US010514232B2

(12) United States Patent
Smoker

(10) Patent No.: US 10,514,232 B2
(45) Date of Patent: Dec. 24, 2019

(54) LAUNCHING AERIAL DEVICES

(71) Applicant: Lockheed Martin Corporation, Bethesda, MD (US)

(72) Inventor: Thomas William Smoker, Hants (GB)

(73) Assignee: Lockheed Martin Corporation, Bethesda, MD (US)

( * ) Notice: Subject to any disclaimer, the term of this patent is extended or adjusted under 35 U.S.C. 154(b) by 20 days.

(21) Appl. No.: 15/319,397

(22) PCT Filed: Jun. 17, 2015

(86) PCT No.: PCT/EP2015/063646
§ 371 (c)(1),
(2) Date: Dec. 16, 2016

(87) PCT Pub. No.: WO2015/193399
PCT Pub. Date: Dec. 23, 2015

(65) Prior Publication Data

US 2017/0146317 A1 May 25, 2017

(30) Foreign Application Priority Data

Jun. 19, 2014 (GB) ..... 1410942.5

(51) Int. Cl.
*F41F 3/07* (2006.01)
*F41F 3/042* (2006.01)

(52) U.S. Cl.
CPC ..... *F41F 3/07* (2013.01); *F41F 3/042* (2013.01)

(58) Field of Classification Search
CPC ..... F41F 3/042; F41F 3/07
USPC ..... 89/1.809, 1.81
See application file for complete search history.

(56) References Cited

U.S. PATENT DOCUMENTS 3,208,346 A * 9/1965 Penza ..... F41F 3/07 89/1.809
3,242,810 A * 3/1966 La Pointe ..... F41F 3/07 89/1.81
3,249,014 A * 5/1966 Daughenbaugh ..... F41F 3/07 89/1.809
3,279,319 A * 10/1966 Semonian ..... F41A 1/10 89/1.81
3,301,132 A * 1/1967 Lehmann ..... F41F 3/07 89/1.81
5,170,005 A * 12/1992 Mabry ..... F41F 3/07 89/1.11

(Continued)

FOREIGN PATENT DOCUMENTS

WO WO 2011/152904 A2 12/2011
WO WO 2013/126111 A2 8/2013

*Primary Examiner* — Stephen Johnson
*Assistant Examiner* — Benjamin S Gomberg
(74) *Attorney, Agent, or Firm* — Wolf, Greenfield & Sacks, P.C.

(57) ABSTRACT

A launch container apparatus for ejection from a submerged launch platform and a method for ejecting a launch container apparatus are disclosed. The apparatus comprises an enclosure for carrying an unmanned aerial device and a surfacing sensor configured to generate a control signal in response to detection of surfacing of the launch container apparatus. Petals are configured to provide buoyancy and stabilization for the launch container apparatus are also provided. A petal drive mechanism moves, in response to the control signal, the petals from a folded position to an expanded position.

12 Claims, 7 Drawing Sheets

(56) References Cited

U.S. PATENT DOCUMENTS

| | | | | |
|---|---|---|---|---|
| 6,164,179 | A * | 12/2000 | Buffman | F41F 3/07 114/316 |
| 7,472,866 | B2 * | 1/2009 | Heaston | B63G 8/28 244/63 |
| 7,946,241 | B2 * | 5/2011 | Sampson | B63B 22/003 114/261 |
| 8,091,461 | B1 * | 1/2012 | Buescher | F41F 7/00 114/318 |
| 8,205,828 | B2 * | 6/2012 | Bossert | F41F 3/07 114/238 |
| 8,596,181 | B2 * | 12/2013 | Root, Jr. | B63B 22/06 102/406 |
| 8,662,441 | B2 * | 3/2014 | Powell | B64C 39/024 244/62 |
| 9,453,705 | B2 * | 9/2016 | Sylvia | B63G 8/001 |
| 2009/0107386 | A1 * | 4/2009 | Sampson | B63B 22/003 114/261 |

* cited by examiner

LAUNCHING AERIAL DEVICES

RELATED APPLICATION

This application is a national stage filing under 35 § 371 of international application PCT/EP2015/063646, filed on Jun. 17, 2015, which claims priority to United Kingdom patent application number 1410942.5, filed Jun. 19, 2014, each of which is incorporated herein by reference in its entirety.

FIELD OF THE INVENTION

This invention relates to a container apparatus and method for launching unmanned aerial devices into airspace above a submerged launch platform.

BACKGROUND

Various unmanned aerial devices or unmanned aerial systems (UAS) can be launched into air. Unmanned aerial devices comprise remotely and/or autonomously controlled devices that operate in the air without a human operator on board. Examples of unmanned aerial devices/systems include unmanned aerial vehicles (UAVs) and various airborne intelligence, surveillance, targeting and reconnaissance systems.

Launching aerial devices from submerged launch platforms, for example a submarine, poses certain problems. Conventional launch solutions that might be used on land, on ships or other non-submerged platforms are not well suited for use on submerged platforms because they are designed to launch aerial devices into clear air, not through a layer of water. Furthermore, aerial devices are not typically designed to operate in submerged conditions and for travel through water, and can be damaged and/or operate in unexpected or uncontrollable manner if launched into water.

Therefore improved apparatus for launching aerial devices from a submerged launch platform would be desired.

SUMMARY

According to an aspect of the present invention there is provided a launch container apparatus for ejection from a submerged launch platform. The apparatus comprises an enclosure for carrying an unmanned aerial device, a surfacing sensor configured to generate a control signal in response to detection of surfacing of the launch container apparatus, petals configured to provide buoyancy and stabilization for the launch container apparatus, and a petal drive mechanism configured to move, in response to the control signal, the petals from a folded position to an expanded position.

According to another aspect of the present invention there is provided a method for launching an unmanned aerial device, comprising ejecting a container apparatus carrying the unmanned aerial device from a submerged launch platform, detecting by a water surfacing sensor surfacing of the container apparatus and in response thereto generating a control signal, and moving, in response to the control signal, petals of the launch container apparatus from a folded position to an expanded position to provide buoyancy and stabilization for the launch container apparatus.

According to yet another aspect of the present invention there is provided a computer program comprising code means adapted to perform, when run on processor apparatus, a method comprising receiving a signal indicative surfacing of a container apparatus launched from a submerged platform and carrying an unmanned aerial device, causing movement, in response to the signal, of petals of the launch container apparatus from a folded position to an expanded position to provide buoyancy and stabilization for the launch container apparatus.

More detailed aspects are evident from the disclosure herein.

DESCRIPTION OF THE DRAWINGS

The present invention will now be described by way of example with reference to the accompanying drawings, in which.

DETAILED DESCRIPTION OF THE DRAWINGS

The following description presents certain examples for unmanned aerial device launch apparatus to enable person skilled in the art to make and use the invention, and is provided in the context of particular applications. Various modifications to the disclosed embodiments will be readily apparent to those skilled in the art. Thus the general principles defined herein may be applied to other embodiments and applications without departing from the spirit and scope of the present invention and the present invention is not intended to be limited to the embodiments shown, but is to be accorded the widest scope consistent with the principles and features disclosed herein. It is noted that in this disclosure the terms unmanned aerial device and unmanned aerial system (UAS) are used interchangeably.

Figure 1:
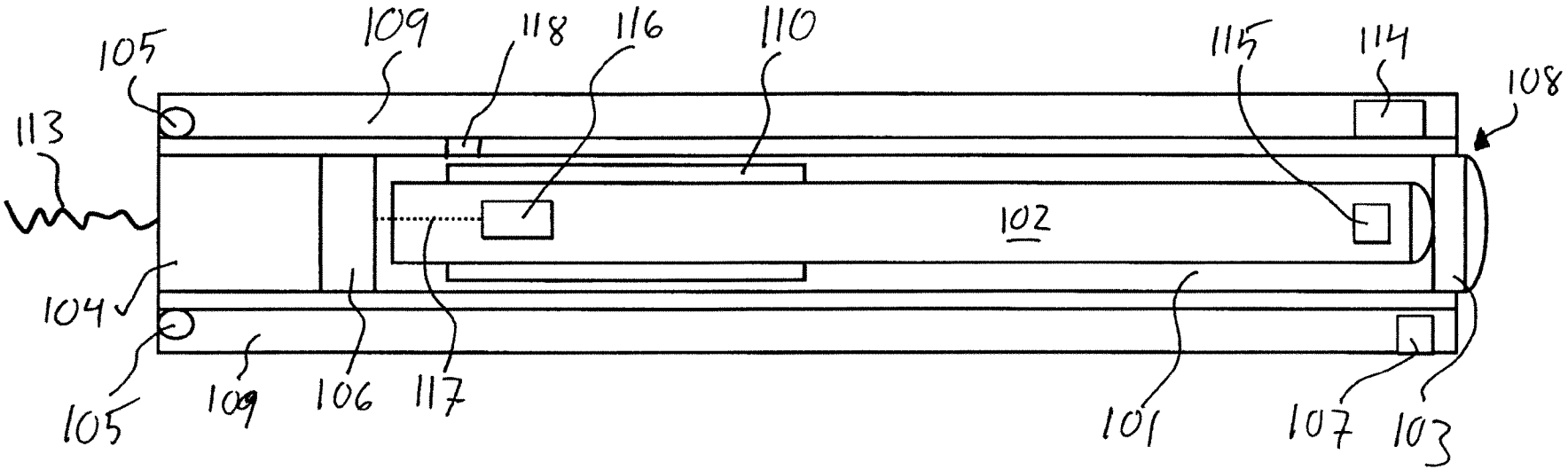
FIG. 1 is a schematic diagram of a launch container apparatus configured in accordance with an embodiment.

FIG. 1 shows an example of apparatus for launch of an unmanned aerial device 102, for example Unmanned Aerial Vehicle (UAV) or another unmanned aerial system from a submerged platform or structure. The unmanned aerial device is carried in an enclosure of a container 100 adapted for ejection through water for delivery of the unmanned aerial device into the airspace above the submerged launch platform.

The launch container as described herein can be adapted for ejection from any kind of underwater launch apparatus. The examples given herein assume the launch platform be a submarine, but the launch platform could equally be any other type of submerged platform or structure. The submerged platform can thus be e.g. a boat, vessel or other submerged structure such as a submerged swimmer delivery vehicle, a submerged delivery structure, and a submerged unmanned autonomous vehicle.

A launch container can be launched from a submarine at approximately periscope depth. However, as no launch mast is needed the submarine can remain entirely submerged. According to a scenario the launch is provided at a depth that allows radio communication between submarine and unmanned aerial device once the unmanned aerial device is airborne.

An appropriate container is open ended at one end to facilitate exit of the aerial device. A watertight nose cap 103 at the open end of the container 100 is provided to prevent water ingress into the container. A storage area 101 of sufficient size to house and store the aerial device is also provided.

The container further comprises a set of stabilisation and buoyancy petals 109 configured to assist ascent of the launch container to the surface, post discharge from the submerged platform or structure, flotation of the container on the surface and to stabilise motion and orientation of the container during the launch of the aerial device from the container. The petals are moveably attached at 105 to the container 100, and have at least two different operating positions.

A drive module 104 is also provided to deploy the stabilisation and buoyancy petals 109 during launch initiation sequence. The drive module can also be used for the deployment of the aerial device 102 through the open ended section of the launch container. A mechanical actuator configured to assist the launch of the aerial device from the launch container may also be provided.

Figure 7:
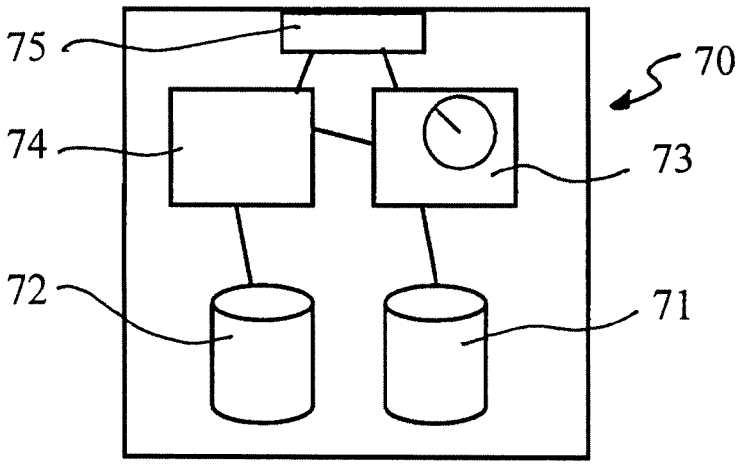
FIG. 7 shows a control apparatus.

The operation of the drive module, the actuator and other possible elements of the container apparatus 100 can be controlled by a control apparatus 106. An example for possible control apparatus is illustrated in FIG. 7.

Launch canister 100 further comprises a surfacing sensor 107 for detecting when the nose cap 103, or another predefined part of the container 100 broaches the surface of the water. The surfacing sensor may be any kind of suitable sensor capable of detecting surfacing of the canister. For example, a hydrostatic switch, a pressure switch or an electronic or electro-optical sensor for detecting the transition from water to air can be provided. In accordance with a possibility a positioning system receiver provides a surfacing information signal in response to acquiring a signal from at least one positioning satellite.

An appropriate launch container can be provided by a circumferential canister. Other sizes, shapes and types of container are also possible, for example to provide improved manoeuvrability, more efficient use of storage space and/or to accommodate particular shapes and/or properties of the submerged launch platform.

A launch canister 100 of FIG. 1 example comprises a watertight enclosure 101 adapted to carry an unmanned aerial device 102. The aerial device 102 may have foldable wings 110 so as to allow adoption of a compact configuration that makes efficient use of space in enclosure 101. The wings can, for example, be of a switchblade or wrap-around design. In case the aerial device 102 is provided with a propeller, this can also be foldable. Folding of any external members of the aerial device can be advantageous because, depending on the launch mechanism for which the container is designed, the external diameter of the container 100 may be as little as 75 mm.

In accordance with a possibility a micro mini unmanned aerial system can be inserted into for example a 75 mm or 100 mm diameter pyrotechnic style canister or a 200 mm diameter under casing launcher. Other canister sizes are also possible, depending on the launch platform and/or the cargo. The canister can be deployed from a pyrotechnic store launcher such as submerged signal ejector (SSE) or under casing launcher (UCL) present in modern submarines, such as countermeasure acoustic device launch cradles. Such launch mechanisms allow rapid deployment of equipment whilst submerged without utilising the submarine's missile or torpedo launch tubes. Use of a submerged signal ejector or under casing launcher instead of the missile or torpedo launch tubes also avoids use of valuable weapon stowage for the UAS. Also, unlike e.g. garbage ejectors of older submarines ejection apparatus such a pyrotechnic stores ejectors are typically always available for use and do not cause excessive noise e.g. because of pumping.

The drive module 104 is arranged to drive the device 102 out of the canister through launch opening 108. The drive module 104 can be any suitable kind of mechanism for launching the device, including a mechanical device (e.g. a catapult or other sprung mechanism), a pyrotechnic device, or a compressed gas charge, or a combination of these. Preferably the drive module utilises pyrotechnic devices to create a high pressure gas charge sufficient to launch the aerial device at the necessary velocity to achieve and attain a normal cruising speed thereof to the required altitude in medium sea states.

Furthermore, position, movement and/or orientation determining apparatus 114, 115 can be provided. Some or all of such determining apparatus can be located at the unmanned aerial system (UAS) 102.

A signalling connection 117 can be provided between the control electronics 106 of the container apparatus 100 and control electronics 116 of the UAS 102. The connection can be based on wired or wireless communication technology.

Figure 2:
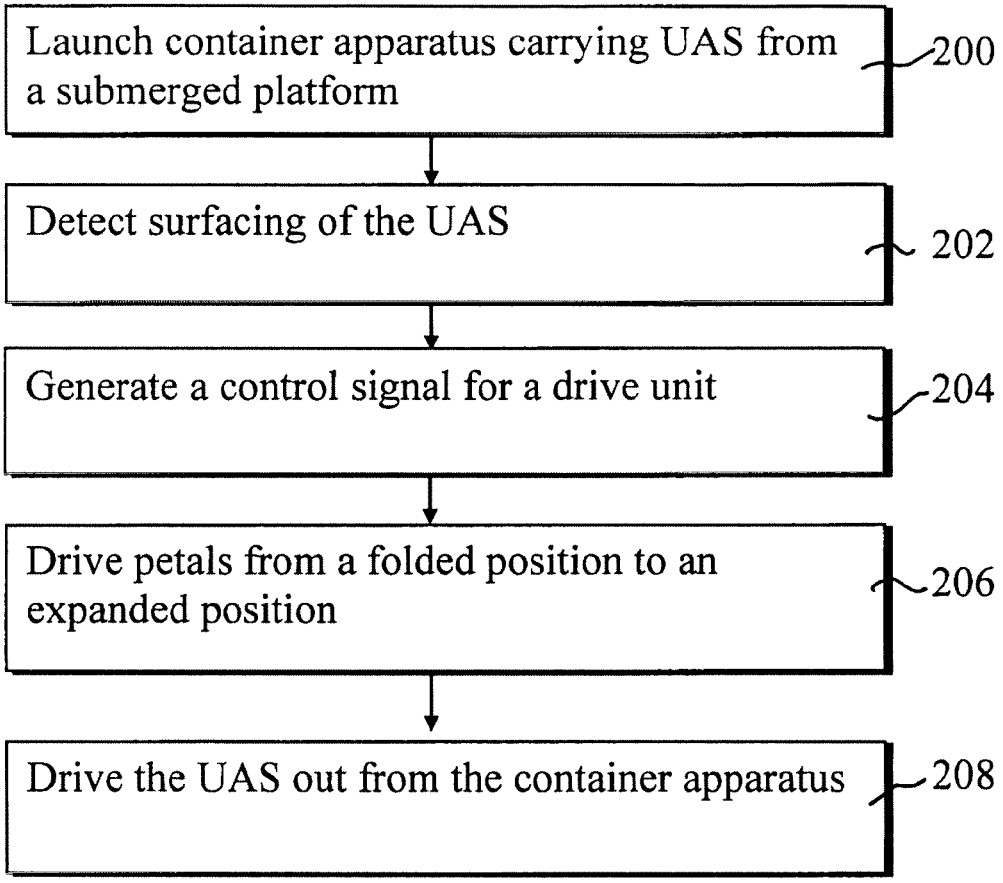
FIG. 2 is a flowchart for launch operation in accordance with an embodiment.

FIG. 2 is a flowchart for operation for launching an unmanned aerial device in accordance with an embodiment. Container apparatus carrying the unmanned aerial device is launched at step 200 from a submerged launch platform. A surfacing sensor detects at 202 that the container apparatus broaches the water surface. In response thereto a control signal is generated at 204 and communicated to a drive unit. Petals arranged moveably on the launch container apparatus are moved, in response to the control signal, at 206 from a folded position to an expanded position. In the expanded position the petals provide buoyancy and stabilization for the launch container apparatus. The unmanned aerial device can then be driven out of the launch container apparatus at 208 after the petals have moved to the expanded position.

Figure 3B:
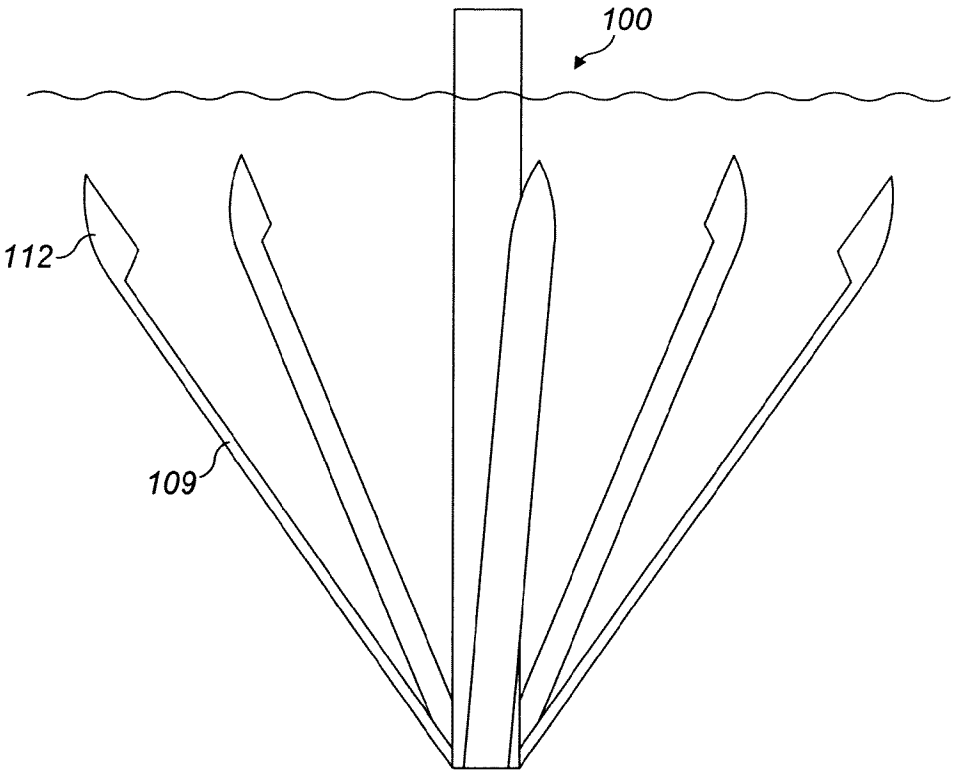
FIGS. 3A to 3C illustrate schematically three petal positions in accordance with an embodiment.
Figure 3A:
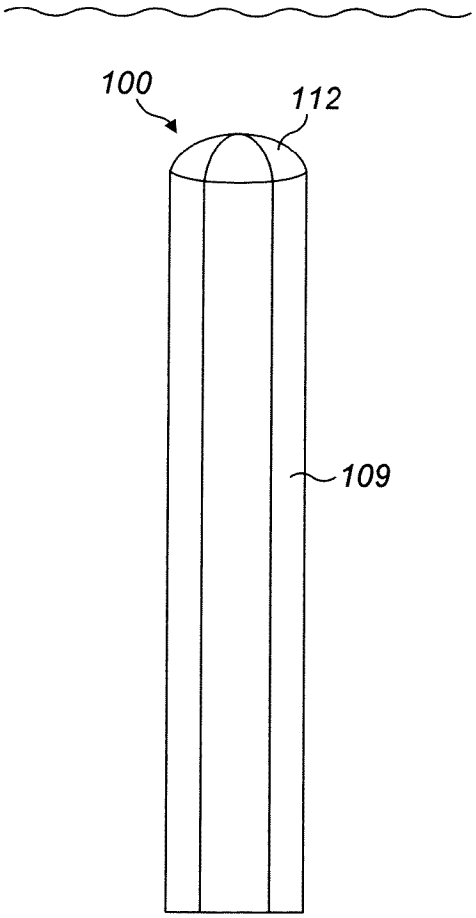
Figure 3C:
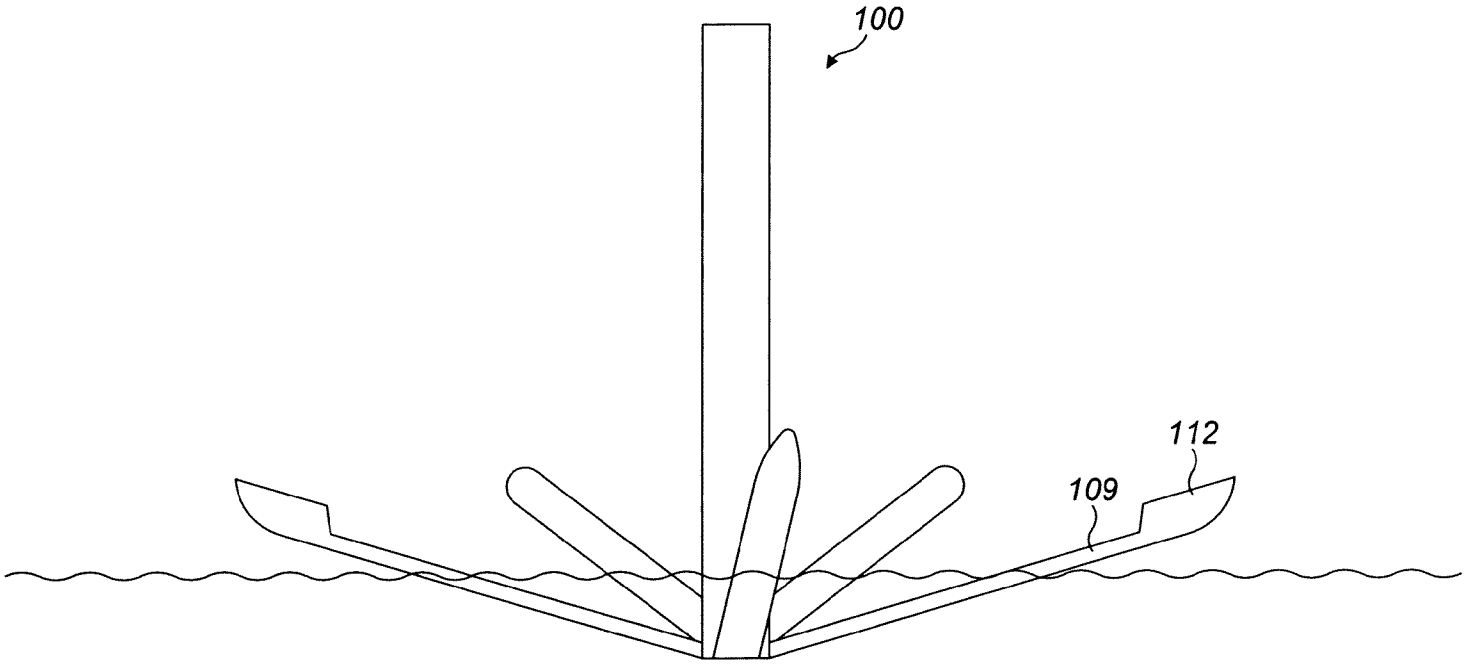

FIGS. 3A, 3B and 3C show five deployable stabiliser and buoyancy petals 109 in three different operational positions. In FIG. 3A the petals 109 are folded against the sides of a launch canister 100, or in launch position. In FIG. 3B the petals 109 are in a half expanded position, or buoyancy position. In FIG. 3C the petals 109 are in a fully expanded position, or recoil position.

When the launch canister 100 has exited the submarine launcher the launch canister ascends to the surface aided by the impulse of the submarines ejecting launch system. At this stage the buoyancy of the launch canister tips at the end of the buoyancy and stabilisation petals.

Each petal may be provided with an inwards extending tip portion 112. This portion can be arranged to cover the nose cap of the canister when the petals are in the folded launch position. On discharge from a submerged launcher the tip portions 112 can provide buoyancy aids for aiding ascent of the canister to the surface. The tip portions 112 can comprise floating material. Floating material may also be provided elsewhere in the petals. Also, the tip portions can provide a protective closure for the cap and/or formed such as to provide improved hydrodynamic properties of the canister apparatus. For example, when closed the tip portions can cover the cap end of the canister and form an appropriate shaped cone at the front end of the apparatus.

The petals can be deployed from the folded position of FIG. 3A once the nose of the canister has surfaced and a surfacing sensor has detected that the nose cap is no longer submerged. In response to a signal from the sensor that the canister has broached, the drive module can deploy the stabiliser and buoyancy petals 109 to a point about midway between the fully stored and fully deployed position, as shown in FIG. 3B. At this position these stabiliser and buoyancy petals are designed to maintain buoyancy and orientation of the launch canister relative to the wave motion of the sea.

Once the required stabilisation and buoyancy have been achieved the on-board control system electronics 116 can deploy the nose cap and open the end of the launch canister enclosure in preparation for the discharge of the UAS through the open end of the launch canister. There are various possible mechanisms for attaching the nose cap to the canister, and therefore the opening thereof can be provided in various manners. For example, the enclosure can be opened by releasing one or more electronic locks, activating one or more explosive pins etc., thereby allowing the enclosure to be open ended in preparation for the UAS to be launched from the enclosure. The nose cap may also be mounted to the launch canister by a sprung hinge that is biased such that when the nose cap is released the nose cap flips away from the launch opening by rotating about the hinge. The nose cap may be held in place by means of one or more locks that are released immediately prior to launch of the UAS so as to allow the UAS to push the nose cap out of the way as it exits the canister (in the case that the UAS is driven out of the canister by an explosive or compressed gas charge it could be the rapidly expanding gas itself that pops of the nose cap). The nose cap may also comprise a waterproof diaphragm through which the UAS is forced on being driven from the launch canister in this case there need not be any explicit release of the nose cap since it stays in place during launch, but the canister can additionally include a further protective nose cap over the diaphragm that is released on the canister broaching the water surface.

In accordance with a possibility a launch canister may have an on-board fitted Inertial Measurement Unit (IMU) 114 to detect the motion of the launch canister 100. The IMU can signal canister motion data to the control electronics 116 of the UAS 102 to assist in the UASs discharge initiation sequence. Furthermore, a positioning system unit 115 may also be provided in the UAS and/or in the canister itself. For example, the UAS may comprise a Global Positioning System (GPS) receiver. The canister motion data along with the GPS receiver acquiring a GPS satellite lock can be used to determine when the UAS is ready for the on-board control system electronics to initiate a discharge sequence from the enclosure.

In case of a removable cap, once the cap is removed, the UAS is open to air and can determine its position based on signals received from a positioning system such as GPS satellites. Alternatively, or in addition, a GPS receiver can be provided on the canister. Attitude data can also be determined, based on a sensor arrangement 114 of the canister and/or based on a sensor arrangement of the UAS. Once this information is determined the UAS 102 can alert the control system 106 of the launch canister 100 that it is ready for launch. The control system of the canister can then deploy the petals to a rowing stroke which fully deploys the petals to act as a water brake to the force caused by launching of the aerial device. This position also further projects the launch canister above the surface of the water.

Figure 4:
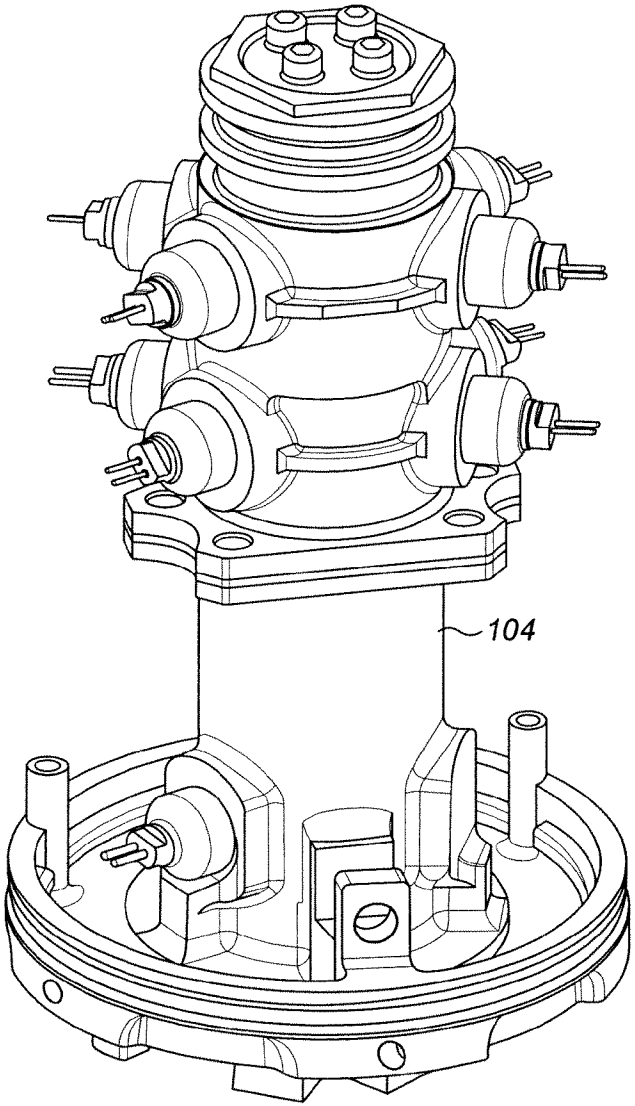
FIG. 4 shows an example of a drive module for launch container apparatus.

Subsequent to the UAS 102 acquiring its positions from e.g. GPS satellites and the launch canister motion being determined to be within predefined sea state parameters, the drive module 104 of the launch canister can initiate the next stage of the UAS discharge sequence. At this stage the drive module fully deploys the stabiliser and buoyancy petals 109 to act as a buffer to the pyrotechnic recoil and to extend the launch canister's opening 108 further out of the water. A non-limiting example of a drive module 104 is shown in FIG. 4.

Figure 5:
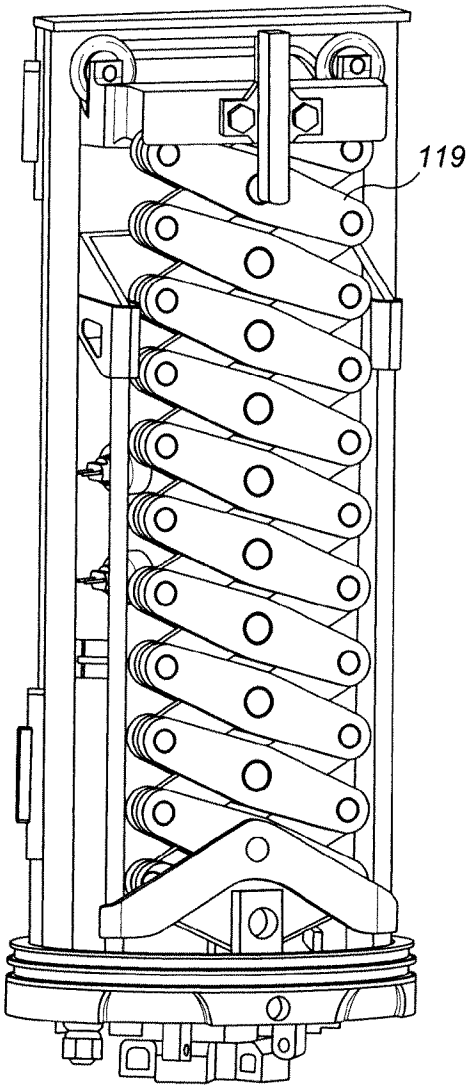
FIG. 5 shows an example of a mechanical actuator for launch container apparatus.

When the petals are in the water brake position the control system of the canister can initiate the drive module to generate necessary gas charge to launch the aerial device out of the canister. When the stabiliser and buoyancy petals 109 are fully deployed in the recoil position, the drive module 104 initiates the next stage of the discharge sequence and creates a high pressure gas charge to propel the UAS 102 out of the opening 108. This operation can be aided by a mechanical actuator, for example an actuator 119 of FIG. 5.

Once the UAS 102 has been successfully deployed from the launch canister 100 and after a specific time period during the launch initiation sequence, a second opening 118 on the canister can be opened up to sea allowing the launch canister to be scuttled. The operation can be controlled by a timer of the control apparatus 106.

In case the UAS is an unmanned aerial vehicle (UAV), it may be deployed from the canister at a velocity that is equivalent to the UAVs normal cruise speed.

The UAV wings 110 in the folded position in the UAV storage area 101 can now start to unfold and deploy as the UAV transitions from its stored state in the launch canister 101 to its flight state. The action of the UAV 102 unfolding and fully deploying its wings and propeller engages a switch causing the UAV power to be connected to the engine and starts to turn the propeller. Once the device is ejected out it can attain its cruise speed and flight configuration during its ascent to for example normal cruising altitude. After a for example 7 second delay from canister broach the canister can self-scuttle itself.

The launch canister 100 may further comprise a data umbilical type connector 113 for connection between the launch canister and the launch platform, e.g. a submarine launch tube. The data umbilical can be used to exchange navigation and UAS initialisation data between the UAS and a control station for the UAS at a host platform.

Additionally or alternatively, during the deployment of the launch canister 100, the data umbilical 113 can be disconnected from the launch canister and host platform during the launch canister deployment. According to a possibility it can remain attached to allow operators to pass over data to the UAS 102 from the host platform.

Additionally or alternatively, the launch canister can comprise one or more float devices to aid the launch canister in achieving an optimal launch angle for the UAS at the water's surface. The float devices can be provided in association with the petals. For example, inflatable floating devices can be provided at the ends, or close to the ends, of the petals. Inflation of the float devices could be triggered by a lanyard in a similar manner. In certain embodiments, a second lanyard could also be used to complete power and/or data paths between the launch platform and the UAS.

In accordance with an example the launch of a UAS can be provided in several stages. In first phase, a launch canister can be ejected in a first direction by a compressed gas charge from an SSE launch tube of submarine whilst the submarine is submerged. A lanyard can be connected between the launch canister and launch tube. At next phase, the lanyard extends to a predetermined length at which lanyard branch pieces pull taut and shears pins securing sprung steer-away fins in a stowed position, allowing the steer-away fins to spring and lock into a deployed position. The remote end of lanyard then detaches from the launch tube at next phase in response to the main length of lanyard pulling taut at a second predetermined length. The steer-away fins act to guide the canister's motion away from the submarine so as to avoid collision with any parts of the submarine and ensure that the canister maintains a good orientation for launching its payload. At next phase, the launch canister reaches the surface of the water and its surfacing sensor causes deployment of the petals and initiation of other UAS launch operations described above. As the UAS clears the launch canister its wings and tail planes spring and lock into their deployed positions and the engine of the UAV powers up.

Figure 6:
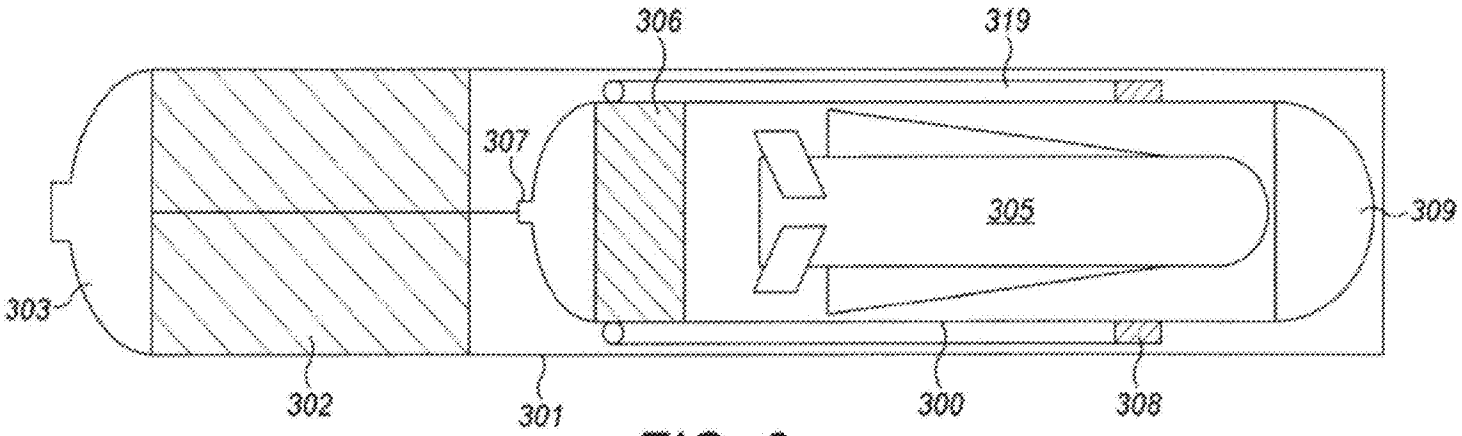
FIG. 6 shows an example of an under casing launcher.

FIG. 6 shows a launch canister 300 adapted for launch from an Under Casing Launcher (UCL) of a submarine. UCLs are launch devices provided outside the pressure hull of a submarine and configured to eject a payload from a launch tube 301 adapted to withstand the dive pressures experienced by a submarine hull. The UCL can carry a launch canister 300 configured in accordance with the present invention and comprising moveable petals 319 for carrying a UAV 305.

UCL can include a compressed gas charge 302 for ejecting the launch canister from the tube and an end piece 303 having an electrical connector for connection to the submarine by means of which power and/or data can be provided to the UCL. Launch canister 300 comprises an electrical connector 307 for connection to the UCL and hence to the submarine. In this manner the UAV can be charged and/or initialisation and navigation data uploaded to the UAV. The electrical connection to the launch canister could be provided by a lanyard, but preferably a canister adapted for launch from a UCL does not included a lanyard for tethering to the UCL. A simple flotation collar 308 can be used to guide the motion of the launch canister to the surface and also improve its buoyancy. This can be provided to allow heavier UAVs to be launched by the mechanisms described herein.

Launch canister 300 operates to launch its UAV in the same manner as launch canister 100, with a launch mechanism 306 (e.g. a compressed gas charge) being used to eject the UAV from the launch canister, and nose cap 309 being released to allow the UAV to exit the canister after broaching the surface of the water.

FIG. 7 shows an example of a control apparatus 70 for a UAS and/or for the launch container apparatus. The control apparatus can be configured to provide control functions in association with the above described launch operation. For this purpose the control apparatus comprises at least one memory 71, 72, at least one data processing unit 73, 74, and an input/output interface 75. Via the interface the control apparatus can be coupled to at least one external sensor and at least one other control apparatus. The control apparatus can be configured to execute an appropriate software code to provide the control functions. The required data processing apparatus and functions may be provided by means of one or more data processors. The data processors may be of any type suitable to the local technical environment, and may include one or more of general purpose computers, special purpose computers, microprocessors, digital signal processors (DSPs), application specific integrated circuits (ASIC), gate level circuits and processors based on multi core processor architecture, as non-limiting examples. The data processing may be distributed across several data processing modules. A data processor may be provided by means of, for example, at least one chip. The memory or memories may be of any type suitable to the local technical environment and may be implemented using any suitable data storage technology, such as semiconductor based memory devices, magnetic memory devices and systems, optical memory devices and systems, fixed memory and removable memory.

Figure 8:
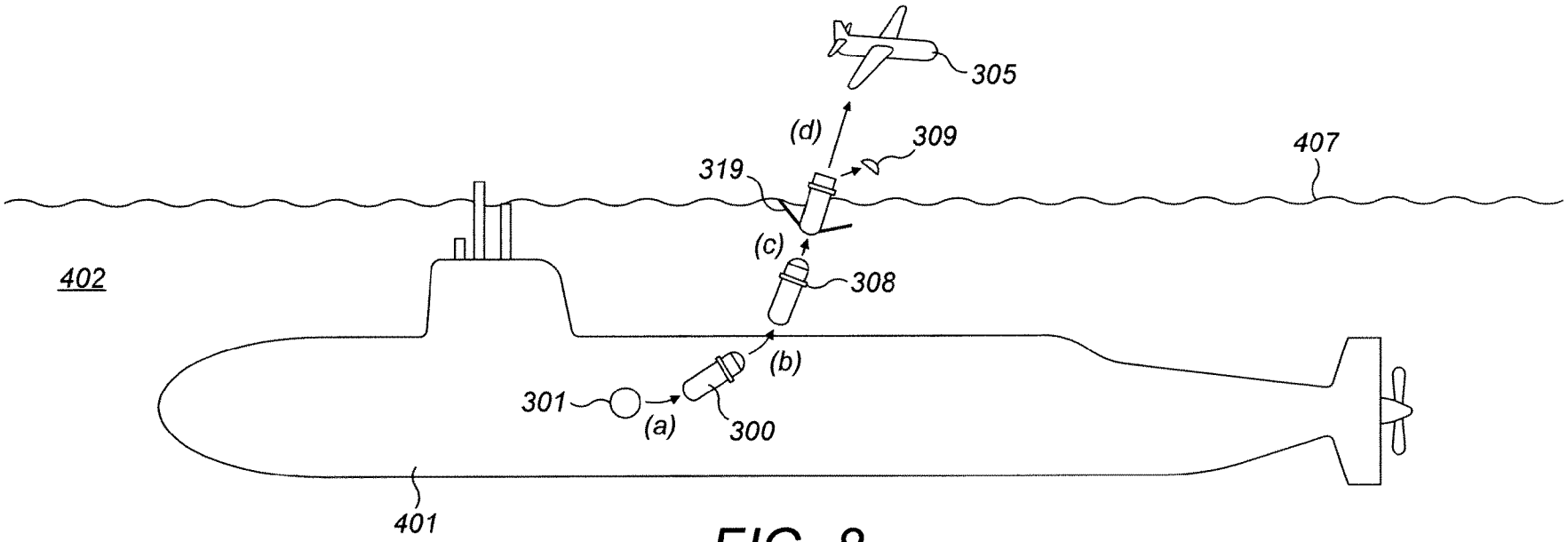
FIG. 8 is an example of a possible submerged launch platform.

FIG. 8 shows a submarine 401 at periscope depth beneath the water surface 407 and comprising an Under Casing Launcher 301. Launch canister 300 is ejected from the UCL at phase (a) with its subsequent motion in phase (b) through water 402 to the surface being guided by flotation collar 308 whose inflation could be activated on launch of the canister (e.g. by means of a hydrostatic switch). At phase (c) the launch canister broaches the surface 407 and in response a surface sensor causes petals 319 to be deployed and nose cap 309 to be jettisoned. Further in response to broaching the surface of water 402, UAV 305 is launched from the canister and hence driven into the air where it enters flight mode and powers away to complete its mission.

Whether ejected from an SSE or a UCL, a launch canister according to the present invention therefore operates according to the same principles, but the preferred guidance mechanisms (e.g. the use of steer-away fins or flotation devices) employed can differ. More generally, however, any of the features of a launch canister described herein in relation to any of the figures can be used in any combination with any other features. The launch canisters and stepwise launch procedures described herein are merely illustrative and represent preferred embodiments of the present invention. For example, launch canisters according to the present invention could use both steer-away fins and floats to guide the passage of the canister through water, or neither such guide elements.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A launch container apparatus for ejection from a submerged launch platform, comprising:

an enclosure for carrying an unmanned aerial device, a launch mechanism for driving the unmanned aerial device out of the enclosure, a surfacing sensor configured to generate a control signal in response to detection of surfacing of a predefined part of the launch container apparatus, a motion sensor for detecting motion of the enclosure, petals configured to provide buoyancy and stabilization for the enclosure, and a petal drive mechanism configured to drive, in response to the control signal, the petals from a folded position to a first expanded position, wherein the first expanded position comprises an intermediate position in which the petals provide the buoyancy, wherein the petal drive mechanism is further configured to drive the petals to a second expanded position comprising a recoil position for use during launch of the unmanned aerial device from the enclosure;

wherein the launch mechanism is configured to be initiated in response to a determination made by the motion sensor that the enclosure has stabilized after the petals have been moved to the first expanded position; and wherein the petal drive mechanism is configured to drive the petals to the second expanded position in response to the determination.

2. The launch container apparatus as claimed in claim 1, wherein the launch mechanism comprises a mechanical actuator.

3. The launch container apparatus as claimed in claim 1, wherein the surfacing sensor comprises at least one of a hydrostatic switch, a pressure switch, an electronic switch, an electro optical switch, and a satellite position system receiver.

4. The launch container apparatus as claimed in claim 1, further comprising at least one of an orientation sensor and a position system receiver.

5. The launch container apparatus as claimed in claim 1, wherein the motion sensor is an inertial measurement unit.

6. The launch container apparatus as claimed in claim 1, further comprising a releasable nose cap in a launch opening of the enclosure, the releasable nose cap being configured to be released from the launch opening in response to the control signal from the surfacing sensor.

7. The launch container apparatus as claimed in claim 1, further comprising a data umbilical for connection to the submerged launch platform for exchanging navigation and initialization data between the submerged launch platform and the launch container apparatus.

8. The launch container apparatus as claimed in claim 1, wherein the petals comprise portions configured to extend over an open end of the enclosure.

9. The launch container apparatus as claimed in claim 1, wherein the petals comprise floating material or devices.

10. The launch container apparatus as claimed in claim 1, wherein the submerged launch platform is one of a submarine, a submerged swimmer delivery vehicle, a submerged delivery structure, and a submerged unmanned autonomous vehicle.

11. A method for launching an unmanned aerial device, comprising:

ejecting a launch container apparatus having an enclosure carrying the unmanned aerial device from a submerged launch platform and having a launch mechanism for driving the unmanned aerial device out of the enclosure, detecting, by a water surfacing sensor, surfacing of a predefined part of the launch container apparatus and in response thereto generating a control signal, moving, in response to the control signal, a petal drive mechanism of the launch container apparatus to drive petals of the launch container apparatus from a folded position to a first expanded position to provide buoyancy and stabilization for the enclosure, wherein the first expanded position comprises an intermediate position in which the petals provide the buoyancy, detecting, by a motion sensor, motion of the enclosure, initiating the launch mechanism in response to a determination made by the motion sensor that the enclosure has stabilized after the petals have been moved to the first expanded position, and driving the petals, in response to the determination, to a second expanded position comprising a recoil position for use during launch of the unmanned aerial device from the enclosure.

12. A non-transitory computer program product comprising code means adapted to perform, when run on a processor apparatus, a method comprising:

receiving, from a surfacing sensor, a control signal indicative of surfacing of a predefined part of a launch container apparatus ejected from a submerged launch platform, the launch container apparatus having an enclosure carrying an unmanned aerial device and having a launch mechanism for driving the unmanned aerial device out of the enclosure, causing movement, in response to the control signal, of a petal drive mechanism of the launch container apparatus to drive petals of the launch container apparatus from a folded position to a first expanded position to provide buoyancy and stabilization for the enclosure, wherein the first expanded position comprises an intermediate position in which the petals provide the buoyancy, causing initiation of the launch mechanism in response to a determination made by a motion sensor that the enclosure has stabilized after the petals have been moved to the first expanded position, and in response to the determination, causing movement of the petal drive mechanism of the launch container apparatus to drive the petals to a second expanded position comprising a recoil position for use during launch of the unmanned aerial device from the enclosure.

* * * * *